United States Patent [19]

Koroscil et al.

[11] Patent Number: 4,682,544

[45] Date of Patent: Jul. 28, 1987

[54] CHEMILUMINESCENT LIGHT CONTAINER

[75] Inventors: Anthony Koroscil, Escambia; Walter A. Smithey, Santa Rosa, both of Fla.; Paul A. Delgado, Oxnard, Calif.

[73] Assignees: American Cyanamid Company, Stamford, Conn.; Del Manufacturing, Oxnard, Calif.

[21] Appl. No.: 813,344

[22] Filed: Dec. 26, 1985

[51] Int. Cl.[4] ..... F42B 4/26

[52] U.S. Cl. ..... 102/336; 252/700; 362/33

[58] Field of Search ..... 102/332, 336, 513; 252/700; 362/33

[56] References Cited

U.S. PATENT DOCUMENTS

| | | | |
|---|---|---|---|
| 3,612,857 | 10/1971 | Beatty et al. | 252/700 X |
| 3,625,152 | 12/1971 | Schneider et al. | 102/336 X |
| 3,893,938 | 7/1975 | Rauhut | 252/700 |
| 3,940,605 | 2/1976 | Gerber | 102/33 X |
| 3,974,086 | 8/1976 | Rauhut et al. | 252/700 |
| 3,994,820 | 11/1976 | Maulding et al. | 252/700 |
| 4,313,843 | 2/1982 | Bollyky et al. | 252/700 |
| 4,379,320 | 4/1983 | Mohan et al. | 252/700 X |
| 4,508,642 | 4/1985 | World | 252/700 |

*Primary Examiner*—Peter A. Nelson

*Attorney, Agent, or Firm*—Frank M. Van Riet

[57] ABSTRACT

A container adapted for insertion into a device is disclosed wherein the container has fitted into its hollow interior the components required to form therein and eject therefrom a chemiluminescent light emitting material upon impact of the device.

6 Claims, No Drawings

CHEMILUMINESCENT LIGHT CONTAINER

BACKGROUND OF THE INVENTION

One of the most important requirements in the training of military personnel, especially in those branches of the service wherein there is a need to train in the area of projectiles e.g. bombs, shells etc., is the ability to detect the accuracy of the subject being trained. In the air force, for example, it is important to be able to determine the accuracy of bombing etc. in order to calibrate equipment and train pilots and bombardiers.

Presently there is being used various devices for determining the exact area in which a projectile falls. The most used devices are pyrotechnics which produce a flash of light and a puff of smoke to indicate the site of projectile impact. One such device employs titanium tetrachloride which produces a cloud of smoke when it reacts with the moisture in the air on impact. A second such device is a red phosphorus bearing projectile which emits a flash of light upon impact.

The problems attendant these types of detection devices are numerous. The main problems, however, are that the phosphorus device generates light by burning and, as a result, many items with which the burning phosphorus comes into contact also burn i.e. trees, shrubs; grass etc. while the titanium tetrachloride devices, because they only emit smoke, are practically useful for nighttime detection.

Amine materials known to emit chemiluminescent light on contact with the atmosphere have also been used however, the light emitted is not of a high enough intensity to provide accurate detection.

SUMMARY OF THE INVENTION

A novel container adapted for insertion into a device for use in creating a signal has been devised. The container has fitted into its interior, a fuse or percussion cap, a propellant, a chemiluminescent light activator solution, a chemiluminescent light fluorescer solution, a non-reactive enhancer and a sealing means. The chemiluminescent light is produced upon impact of the device.

DESCRIPTION OF THE INVENTION INCLUDING PREFERRED EMBODIMENTS

A typical practice device which is utilized in the training of personnel and which creates a detectible signal upon impact normally is of a tear-drop configuration with a hollow core running its entire length. A cartridge fits into the hollow core at the front end of the device. A firing pin at the front end of the device detonates the cartridge upon impact and the signal is emitted through the hollow core at the rear end in the form of a flash of light, smoke etc.

Projectile impact accuracy is normally evaluated by camera from an elevated platform at a distance of one-half to one mile from the target site. Visual inspection of the target site after completion of the test firings or droppings is also used.

Any signal device therefore has to emit a signal which is detectable by the camera if manual inspection of the target site, the least desired method, is to be avoided.

The novel containers of the present invention are useful for both day and night practice and do not function by burning i.e. they are cold, and therefore are free from the disadvantages attendant present devices. They provide non-pyroforic chemical light illumination as a spray of light which can be blue, yellow or green. A secondary benefit is the formation of colored smoke which can be detected in daylight. The instantaneous spray of chemical light lasts preferably less than about one (1) minute and is visible for at least one (1) mile.

The instant invention comprises a hollow container adapted for insertion into a device for use in creating a signal and having fitted into the hollow space or interior thereof, in the following sequence, order or relationship, (a) a fuse of percussion cap,
(b) a propellant,
(c) a chemiluminescent light activator solution,
(d) a chemiluminescent light fluorescer solution,
(e) a non-reactive enhancer capable of absorbing or adsorbing the reaction product produced upon contact of (c) and (d) which occurs upon detonation of said fuse or cap and
(f) a sealing means.

The containers of the present invention are preferably prepared from a metal such as aluminum however, any other material known for the purpose e.g. plastic, may also be used. They generally range in length from about 6–18 inches, preferably 9–15 inches, and in outer diameter from $\frac{1}{2}$ to $1\frac{1}{2}$ inches preferably, about $\frac{3}{4}$ to 1 inch.

The containers have a fuse or percussion cap (a) fitted into one end and then, in sequence, the remaining contents thereof. The fuse or percussion cap can be of any configuration or type and is merely a means of igniting the propellant upon impact of the projectile which is being tested.

The next ingredient, is a propellant (b) and any material known to be useful as such may be used. The preferred propellant is gun powder. Sufficient gunpowder to cause mixing of (c) and (d) upon impact is employed.

The chemiluminescent light activator solution (c), which is preferably used encapsulated within a thin glass ampule, but can be used as such if kept separated from the fluorescer solution, is known in the art. It contains water, catalyst, hydrogen peroxide and solvent. Typical solutions of this type can be found in any one of the following U.S. Pat. Nos.: 3749679; 3391068; 3391069; 3974368; 3557233; 3597362; 3775336 and 3888786, incorporated herein by reference. Preferred solvents include esters, aromatic hydrocarbons and chlorinated hydrocarbons, of which the esters are most preferred, specifically, a mixture of dimethylphthalate and t-butyl alcohol. Preferred catalysts include sodium salicylate, sodium 5-bromosalicylate, lithium bromide and rubidium acetate.

Similarly, the fluorescer solution (d), which is also preferably used encapsulated in a thin, glass ampule, includes, oxalate, of which bis(2,4,5-trichloro-6-carbopentoxyphenyl)oxalate is preferred, and fluorescer of which 9,10-diphenylanthracene (blue), 1-chloro-9,10-bis(phenylethylnyl)anthracene (green) are exemplary, see the above-mentioned patents for further exemplary fluorescer solutions. Esters such as dibutylphthalate are the preferred solvents.

The containers of the present invention must contain the chemiluminescent light components in concentrations which enable the initial outburst of light upon detonation to be intense for a short period of time. This result is achieved by the use of larger amounts of catalyst and hydrogen peroxide as compared to typical chemiluminescent light devices.

The following table sets forth the useful concentration ranges of each ingredient of the chemiluminescent light activator component (c) in the container.

TABLE I

| Ingredient | Concentration* Range | Preferred |
|---|---|---|
| Hydrogen peroxide | 4–15% | 7–10% |
| Catalyst[1] | 0.15–1.1% | 0.3–0.8% |
| Water | 0.6–2.3% | 1.0–1.6% |
| Solvent[2] | remainder | |

*by weight, based on total weight of solution

[1]a preferred catalyst mixture contains .05–.4% sodium salicylate, .05–.3% salicylic acid and .05–.45 rubidium acetate.

[2]the solvent mixture which is preferred contains 75–90%, by weight, of dimethylphthalate and 10–25%, by weight, of tert-butyl alcohol.

The non-reactive enhancers (e) play a significant role in the chemiluminescent light display formed upon detonation of the container of the present invention. The container, upon impact and detonation, forms a concentration area of chemiluminescent light display, of a preferred diameter and preferably at a height which would enable vision thereof from a distance of at least one mile.

The non-reactive enhancer is a material which absorbs or adsorbs the chemiluminescent light generated by mixing components (c) and (d) upon detonation and is ejected from the container into the air and hence onto the ground. Suitable non-reactive enhancers which have been found to be effective for this purpose include small porous, plastic, foamed plugs; small perforated beads of glass etc.; lengths of cellulose acetate fiber tow; cigarette filter staple; other fibrous yarns, e.g. nylon, polyester, rayon; sand, carbon black, alumina mixtures thereof and the like. By "non-reactive" is meant that the enhancer in no way enters into any reaction with the other components of the container.

The sealing means (f) merely comprises a closure of the end of the container to keep the components intact and tightly compressed together. It can comprise a wad of soft material alone or in combination with a screw or compression cap, for example. The wad can range in thickness from 2–10 millimeters.

The following examples are set forth for purposes of illustration only and are not to be construed as limitations on the present invention except as set forth in the appended claims. All parts and percentages are by weight unless otherwise specified.

EXAMPLES 1–18

Simulation of a bomb exploding on impact with the ground is achieved by detonating a 12 inch long, 13/16 inch diameter container in a cannon. The container has an enclosed end containing a fuse and is then packed, in sequence, as follows: 3 grams of smokeless, black gunpowder; a 3.3 mm wad; a 10 ml glass ampule of activator solution; a 10 ml glass ampule of fluorescer solution; enhancer; seal.

Table I, below, sets forth the average of the observer ratings for light intensity and smoke density. Smoke density was only rated at the target site. Light intensity ratings are given at target site and at distances of ½ and 1 mile. After detonation, chemiluminescence continued in the enhancer on the ground for about an average of 10 minutes.

The container is inserted into the rear end of a Cannon and fired from the cannon set at an angle of 10–15 degrees. Detonation starts at dusk and continues into the night. A 10–15 mph wind subsided during the testings.

The following is a compilation of the activator solutions and fluorescer solutions employed.

| | Activator #1 | Activator #2 |
|---|---|---|
| Dimethylphthalate | 385.0 parts | 192.5 parts |
| t-butylalcohol | 73.6 parts | 36.8 parts |
| 86.9% organic process $H_2O_2$ | 54.8 parts | 27.4 parts |
| Sodium Salicylate | 1.4 parts | 1.3 parts |
| Salicylic Acid | 0.6 parts | — |
| Rubidium Acetate | 1.12 parts | — |
| | **Fluorescer #1** | **Fluorescer #2** |
| Dibutylphthalate | 213.0 parts | 210.0 parts |
| Oxalate** | 32.6 parts | 40.0 parts |
| Fluorescer*** | 0.84 part | 0.98 part |

** = bis(2,4,5-trichloro-6-carbopentoxyphenyl)oxalate

*** = 1-chloro-9,10-bis(phenylethynyl)anthracene - yellow

| Enhancer #1 | Enhancer #2 | Enhancer #3 |
|---|---|---|
| Cellulose Acetate Tow | Three 8 foot lengths of Cellulose acetate Tow tied at one end | Cellulose Acetate Staple-1" pieces/glass beads |

Table II, below, shows the combinations of activator solution, fluorescer solution and enhancer employed in the test firings.

TABLE II

| Example | Activator Sol. | Fluorescer Sol. | Enhancer |
|---|---|---|---|
| 1 | #1 | #1 | #1–15 feet |
| 2 | #1 | #1 | #1–18 feet |
| 3 | #1 | #1 | #1–18 feet |
| 4 | #1 | #1 | #1–19 feet |
| 5 | #1 | #1 | #1–19 feet |
| 6 | #1 | #1 | #3–55/45 mix |
| 7 | #1 | #1 | #3–55/45 mix |
| 8 | #1 | #1 | #3–45/55 mix |
| 9 | #2 | #2 | #1–23 feet |
| 10 | #2 | #2 | #1–23 feet |
| 11 | #2 | #2 | #1–23 feet |
| 12 | #2 | #2 | #1–23 feet |
| 13 | #2 | #1 | #2* |
| 14 | #2 | #1 | #2* |
| 15** | #1 | #2 | #1–23 feet |
| 16** | #1 | #2 | #2* |
| 17** | #1 | #2 | #2* |
| 18 | #1 | #1 | #1–23 feet |

*knot beneath sealing means

**wad used directly beneath sealing means

Each of the detonations of Examples 1–17 are visible at one mile. The light and smoke density ratings at different distances by visual ratings of observers stationed at different distances are set forth in Table III, below.

TABLE III

| | Observer Rating of % Light Output at site | | ½ mile | | | |
|---|---|---|---|---|---|---|
| Examples | Ave. | Range | Ave. | Range | 1 mile | Smoke % |
| 1–5 | 68 | 50–80 | 72 | 72–80 | Visible | 60 |
| 6–8 | 70 | 50–85 | 68 | 50–85 | Visible | 73 |
| 9–12 | 78 | 60–90 | 78 | 70–85 | Visible | 78 |
| 13–14 | 80 | — | 85 | 80–90 | Visible | 80 |
| 15 | 80 | — | 85 | 80–90 | Visible | 80 |
| 16–17 | 80 | — | 78 | 70–85 | Visible | 80 |
| 18 | 100 | — | 100 | — | Visible | Not Reported |

EXAMPLE 19

Replacement of the oxalate of Example 1 with 9,10-bis(phenylethynyl)anthracene-(green) results in similar observations.

EXAMPLE 20

Following the procedure of Example 9 except that the fluorescer is 9,10-diphenylanthracene (blue), similar results are achieved.

We claim:

1. A hollow container adapted for insertion into a device for use in creating a signal and having fitted into the hollow space thereof ingredients, in the following sequence, consisting essentially of (a) a fuse of percussion cap, (b) a propellant, (c) a chemiluminescent light activator solution, (d) a chemiluminescent light fluorescer solution, (e) a non-reactive enhancer capable of absorbing or adsorbing the reaction product produced upon contact of (c) and (d) which occurs upon detonation of said fuse or cap and (f) a sealing means.

2. A container in accordance with claim 1 wherein (e) is cellulose acetate fibers.

3. A container in accordance with claim 1 wherein (c) is a t-butyl alcohol dimethyl phthalate solution of hydrogen peroxide and sodium salicylate.

4. A container in accordance with claim 1 wherein (d) is a dibutyl phthalate solution of fluorescer and bis-(2,4,5-trichloro-6-carbopentoxypenyl)oxalate.

5. A container according to claim 1 wherein (c) is a t-butyl alcohol-dimethyl phthalate solution of hydrogen peroxide and sodium salicylate and (d) is a dibutyl phthalate solution of fluorescer and bis(2,4,5-trichloro-6-carbopentoxyphenyl)oxalate.

6. A container according to claim 5 wherein (e) is cellulose acetate fibers.

* * * * *